US007931317B2

(12) United States Patent
Kern

(10) Patent No.: US 7,931,317 B2
(45) Date of Patent: Apr. 26, 2011

(54) REUSABLE TRAILER MOUNTED ATTENUATOR

(76) Inventor: Charles L. Kern, Keyesport, IL (US)

( * ) Notice: Subject to any disclaimer, the term of this patent is extended or adjusted under 35 U.S.C. 154(b) by 19 days.

(21) Appl. No.: 12/046,053

(22) Filed: Mar. 11, 2008

(65) Prior Publication Data

US 2009/0230705 A1 Sep. 17, 2009

(51) Int. Cl.
*B60R 19/18* (2006.01)
*B60R 19/14* (2006.01)

(52) U.S. Cl. ..... 293/118; 293/107; 293/133

(58) Field of Classification Search ..... 293/118, 293/133, 102, 107, 104, 1, 119, 132; 296/187.03, 296/187.07, 182.1; 404/6, 9, 10; 280/287; *B60R 19/18, 19/14*
See application file for complete search history.

(56) References Cited

U.S. PATENT DOCUMENTS

| | | | | |
|---|---|---|---|---|
| 2,984,512 | A | 5/1961 | Shaginaw | |
| 4,284,177 | A | 8/1981 | Domek | |
| 4,711,481 | A | 12/1987 | Krage et al. | |
| 5,199,755 | A | 4/1993 | Gertz | |
| 5,248,129 | A | 9/1993 | Gertz | |
| 5,403,113 | A * | 4/1995 | Gertz et al. | 404/6 |
| 5,642,792 | A | 7/1997 | June | |
| 5,947,452 | A * | 9/1999 | Albritton | 256/13.1 |
| 6,098,767 | A | 8/2000 | Unrath | |
| 6,203,079 | B1 | 3/2001 | Breed | |
| 6,343,821 | B2 | 2/2002 | Breed | |
| 6,523,872 | B2 * | 2/2003 | Breed | 293/119 |
| 6,814,246 | B2 * | 11/2004 | Payne et al. | 213/221 |
| 6,905,282 | B2 | 6/2005 | Leonhardt et al. | |
| 6,926,324 | B1 | 8/2005 | Gertz | |
| 7,070,031 | B2 * | 7/2006 | Smith et al. | 188/382 |
| 2003/0165356 | A1 | 9/2003 | Breed | |
| 2006/0191758 | A1 | 8/2006 | Unrath, Sr. | |
| 2007/0012534 | A1 * | 1/2007 | Murphy | 188/377 |

OTHER PUBLICATIONS

Dimensional Products Inc., U-MAD Unitized Modular Attenuating Device.
Energy Absorption Systems, Inc., Safe-Top Trailer TMA Truck Mounted Attenuator, © Sep. 14, 2005.
Safety Trailers, Inc., Trailer TMA.
Traffix Devices, Inc., Traffix Scorpion Truck Mounted Attenuator Specifications, Jan. 23, 2003.
Trinity Highway Safety Products, Inc., MPS 350 Mobile Protection System, Nov. 11, 2005.

* cited by examiner

*Primary Examiner* — Glenn Dayoan
*Assistant Examiner* — SunSurraye Westbrook
(74) *Attorney, Agent, or Firm* — Grace J. Fishel

(57) ABSTRACT

A reusable trailer mounted attenuator with a collapsible scissor frame assembly supported by front, intermediate and rear vertical frames. A self-adjusting shock absorber with staged metering is attached to the scissor frame assembly and controls its collapse under impact in a manner that deceleration of an impacting vehicle does not exceed permitted rates irrespective of the weight and speed of the impacting vehicle within the design range. Guides are provided to permit the scissor frame assembly to collapse without twisting and a replaceable strike plate with vertical fins concealed with a cover plate is attached to the rear vertical frame.

9 Claims, 5 Drawing Sheets

Top View (Shown Extended Ready for Crash!)

Top View (Shown Collasped Ready for Travel)

Strike Plate (Exploded View)

REUSABLE TRAILER MOUNTED ATTENUATOR

BACKGROUND OF THE INVENTION

1. Field of the Invention

The present invention relates to a vehicle-mounted crash attenuator with a collapsible scissor frame wherein the energy-absorbing member is a self-adjusting shock absorber with staged metering. Guides are provided on the scissor frame to minimize twisting of the frame on impact, after which in most instances only a striker plate need be replaced.

2. Brief Description of the Prior Art

Truck mounted attenuators, commonly referred to as TMAs, are mounted on the rear of a construction vehicle such as a sand truck or the like. The TMA is typically used as a barrier at the rear of a construction project to protect construction personnel from death or injury caused by a vehicle driven by a person who fails to heed warning signs indicating ongoing construction. When a vehicle impacts the rear of the truck having the attenuator mounted thereon, the attenuator absorbs the impact, protecting the construction personnel and ideally preventing damage to the truck and minimizing damage to the impacting vehicle. It is also desirable for the TMA to capture the impacting vehicle so that it does not glance into adjacent traffic or off the road.

A primary problem with existing crash attenuators such as those cited in an information disclosure statement filed herewith is that the attenuators are completely destroyed on impact or that significant parts of the attenuator must be replaced.

BRIEF SUMMARY OF THE INVENTION

In view of the above, it is an object of the present invention to provide a reusable trailer mounted attenuator for attachment to a truck. It is another object to provide a trailer mounted attenuator that tends to ensnare an impacting vehicle and keep it from glancing off. Other objects and features of the invention will be in part apparent and in part pointed out hereinafter.

In accordance with the invention, a trailer mounted crash attenuator includes a collapsible scissor frame connected to front, rear and intermediate vertical frames. The front vertical frame is attached to a tongue, the intermediate vertical frame is mounted on an axle with wheels and a strike plate is attached to the rear vertical frame. In a preferred embodiment, the strike plate includes a plurality of spaced apart vertical fins concealed with a cover plate.

Each of said front, intermediate and rear vertical frames has top and bottom rails with opposing tracks for use with a scissor assembly having an upper and a lower scissor frame. Each of the scissor frames has two groups of parallel scissor arms and each scissor arm of each group with the exception of the scissor arms closest the front and rear vertical frames is pivoted to three scissor arms of the respective other group at the middle and at its two ends. The pivoted ends of the scissor arms of the upper and lower scissor frames are interconnected with vertical uprights and the scissor arms connected at the middle with a pin having an enlarged head. The vertical uprights at the front, rear and intermediate frames have rollers which are reciprocated in the tracks on the front, intermediate and rear vertical frames.

At least one self-adjusting shock absorber with staged metering, such that it becomes stiffer as it is compressed, is pivot mounted in the scissor assembly. Depending on the length of the stroke, the shock absorber may be pivot mounted between one of the uprights at the ends of the scissor arms and an intermediate upright provided between the upper and lower scissor frames. Preferably more than one shock absorber is used to spread the load on the collapsible scissor frame. The shock absorbers are metered such that the scissor assembly may be slowly extended for set up and contracted for towing without undue resistance.

In a preferred embodiment, guides are attached to the front, intermediate and rear frames for receipt of one or more of the enlarged heads of the pins at the middle of the scissor arms such that the scissor assembly collapses on impact without twisting.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 3:
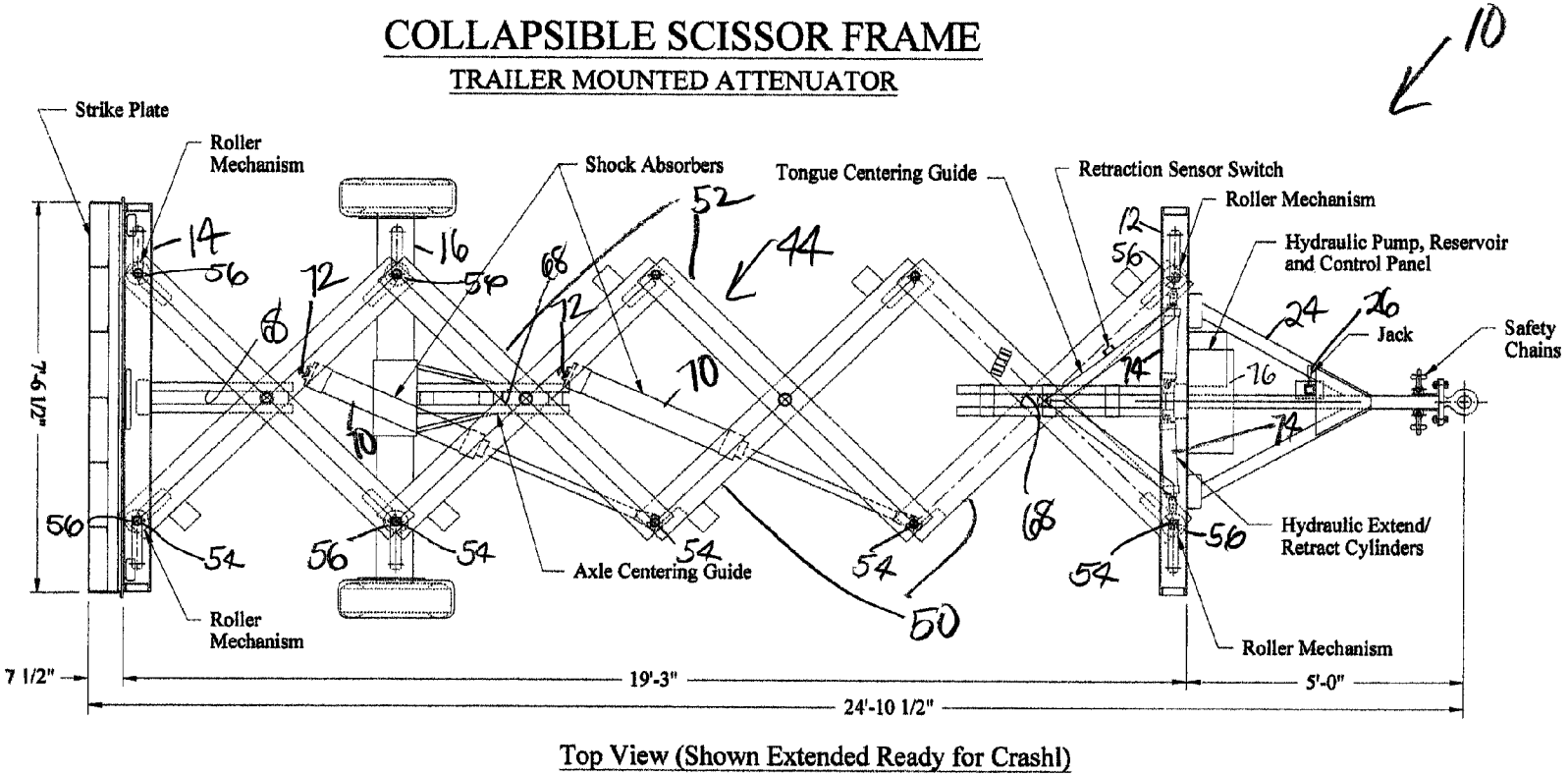
FIG. 3 is a plan view of the trailer mounted attenuator with the collapsible scissor frame extended.

Referring to the drawings more particularly by reference character, reference numeral 10 refers to a trailer mounted attenuator in accordance with the present invention. As best seen in FIG. 3, trailer mounted attenuator 10 has a front vertical frame 12, a rear vertical frame 14 and an intermediate frame 16. Each of front, rear and intermediate frames 12,14 and 16, respectively, include a top and bottom rail 18 and 20, respectively, with opposing tracks 22 (FIG. 5) for use as described hereinafter.

Figure 1:
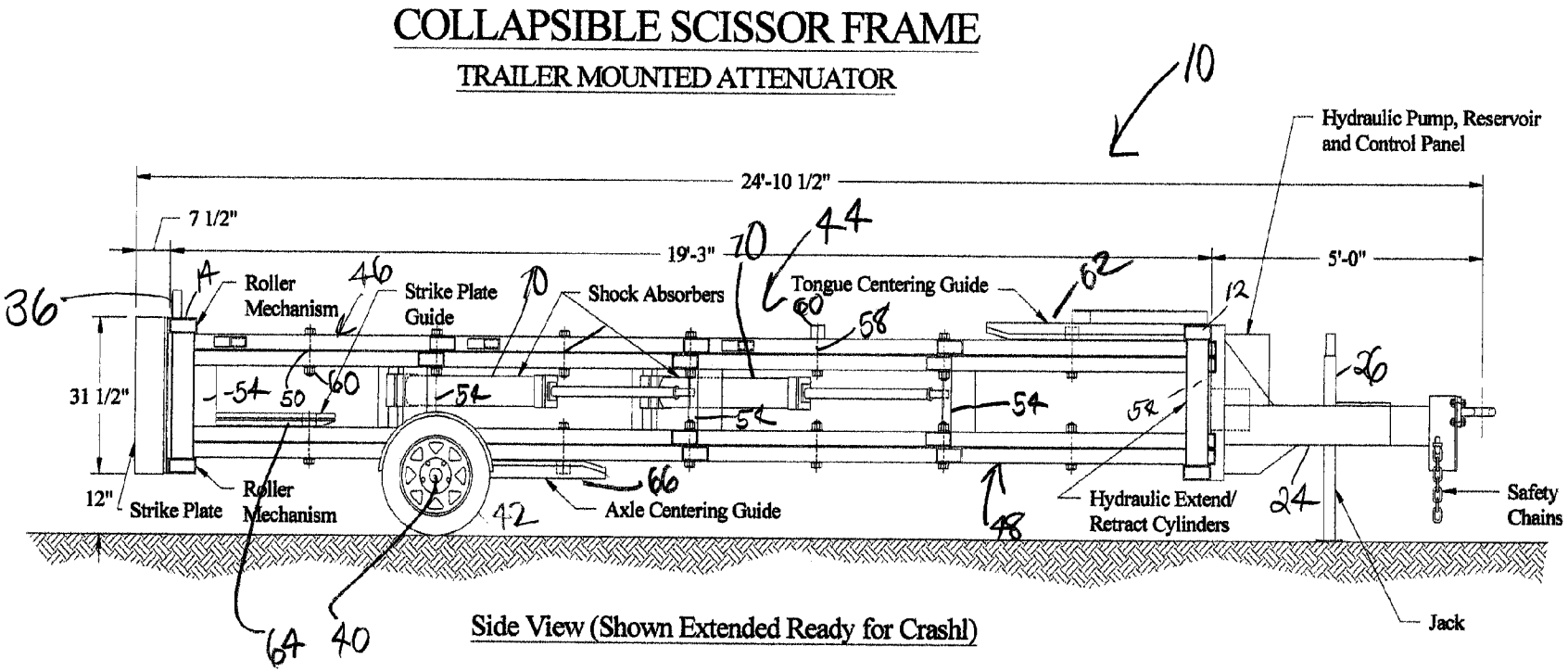
FIG. 1 is a side elevation of a trailer mounted attenuator in accordance with the present invention with the collapsible scissor frame extended.
Figure 5:
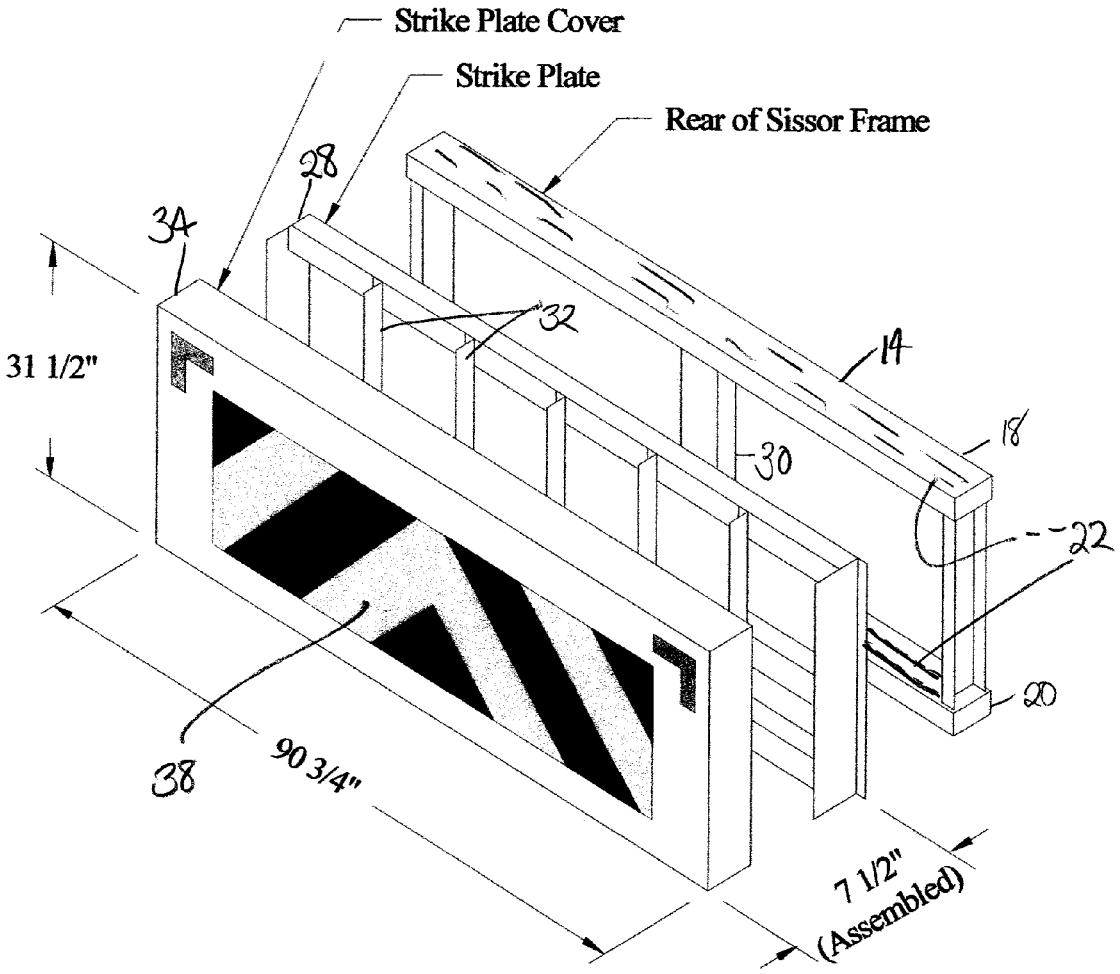

A tongue 24 is attached to front vertical frame 12 by means of which trailer mounted attenuator 10 may be towed. A jack 26 is carried on tongue 24 for providing underlying support and maintaining trailer mounted attenuator 10 in a generally level orientation when detached from a truck for storage. A strike plate 28 best seen in FIG. 5 is attached to rear vertical frame 14 which may be reinforced with a center leg 30. Strike plate 28 includes a frame with a plurality of spaced apart vertical fins 32 which are concealed with a cover plate 34. Stop tail lights 36 (FIGS. 1 and 2) are rubber mounted above strike plate 28 and may not need to be replaced after an impact. Cover plate 34 may be formed of aluminum or some other relatively soft metal and displays a black on yellow inverted "V" chevron pattern 38 for use on the National Highway System. When strike plate 28 is impacted by a vehicle, cover plate 34 is deformed and the vehicle ensnared in fins 32 as described hereinafter. Intermediate vertical frame 16 is mounted on a trailer suspension axle 40 to which wheels 42 are attached.

A scissor frame assembly 44 having an upper and a lower scissor frame 46, 48 (FIGS. 1 and 2) is mounted on front, rear and intermediate vertical frames 12,14 and 16, respectively. Each of scissor frames 46, 48 comprises two groups of parallel scissor arms 50 and 52 (FIG. 3). Each scissor arm of each of group of parallel scissor arms 50 and 52, is pivoted to three scissors arms of the respective other group at the middle and at its two ends with the exception of scissor arms 50 and 52 which are connected to front and rear vertical frames 12 and 14.

The pivoted ends of scissor arms 50 and 52 are mounted on vertical uprights 54 through solid bearings. At front, rear and intermediate vertical frames 12, 14 and 16, respectively, an upper and lower end of vertical frames 54 is provided with a roller 56 by means of which scissor frame assembly 44 is mounted to the frames.

Figure 2:
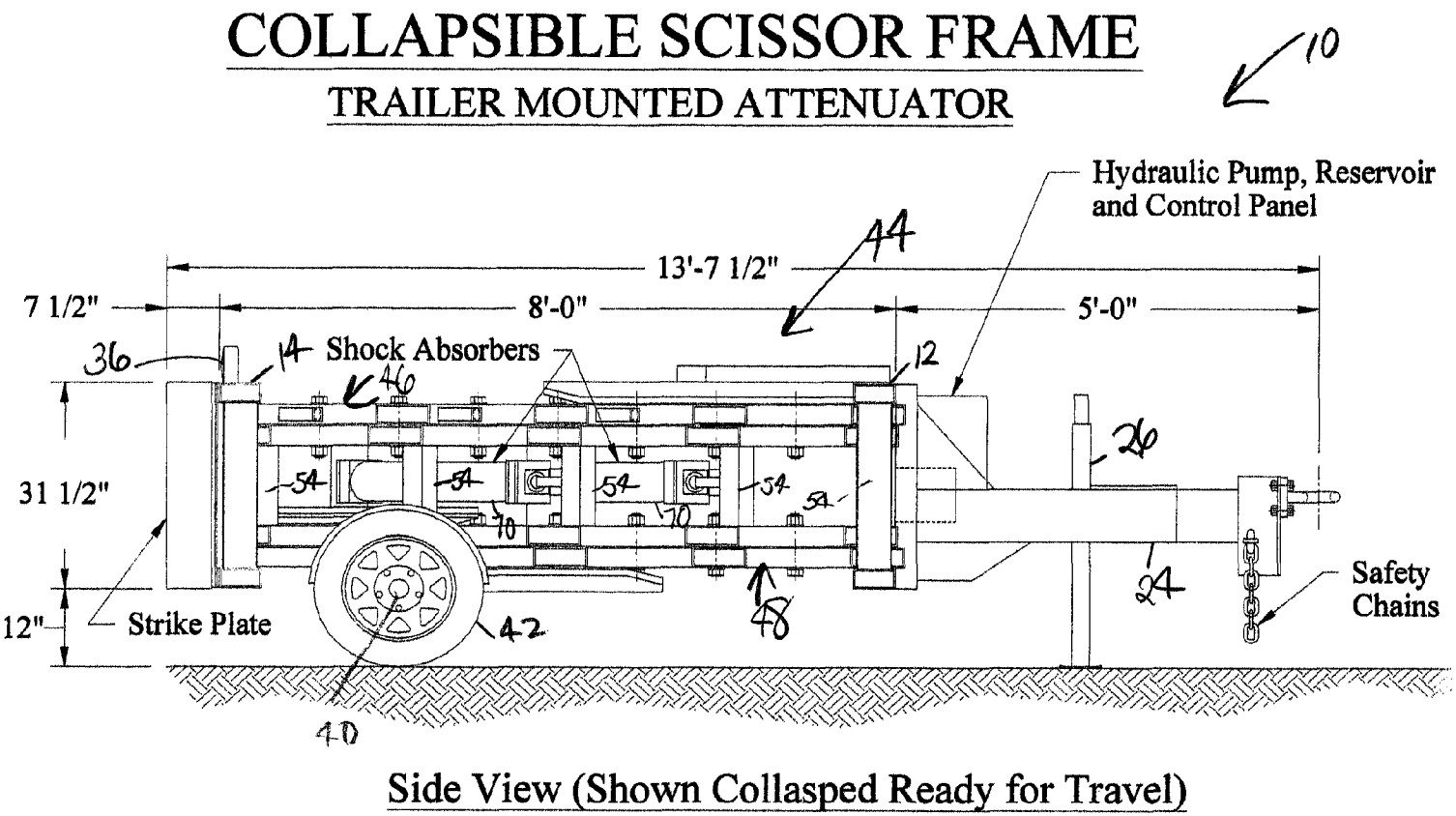
FIG. 2 is a side elevation of the trailer mounted attenuator with the collapsible scissor frame contracted.

A pivot pin 58 with a head 60 is provided for connecting the middle of scissor arms 52 and 54 to a scissor of the respective other group. A guide 62, 64 and 66 is attached to each of front, rear and intermediate vertical frames 12, 14 and 16, respectively. As best seen in FIG. 2, front guide 12 is attached at the top of front vertical frame 12, rear guide 64 intermediate rear vertical frame 14 and intermediate axle centering guide 66 at the bottom of intermediate frame 16. This arrangement permits the scissor frame assembly 44 to collapse without interference between guides 62, 64 and 66. Each of guides 62, 64 and 66 includes a longitudinal slot 68 for receipt of one or more of heads 60 of pivot pins 58 at the middle of scissor arms 50, 52 on one of scissor frames 46, 48 when scissor frame assembly 44 is collapsed on impact or folded for storage and/or transport. For this purpose, with continuing reference to FIG. 2, a forward end of guides 62, 64 and 66 is tapered such that the guides cam over scissor frames 46, 48 as the scissor assembly is collapsed. Wear strips may line longitudinal slot 68. As will be appreciated, heads 60 and guides 62, 64 and 66 keep the scissor frame assembly 44 from twisting and keep rollers 56 in tracks 22 in front, rear and intermediate vertical frames 12, 14 and 16, respectively, moving in concert.

One or more self-adjusting shock absorbers 70 with staged metering are attached to scissor frame assembly 44. Shock absorbers 70 become stiffer as they are compressed and may be custom designed such that they exert selected resistance during selected intervals of the stroke. This permits scissor frame assembly 44 to collapse in a manner such that deceleration does not exceed permitted rates irrespective of whether the impacting vehicle is light-weight (e.g., 1800 pounds) or heavy (e.g., 4500 pounds) within the design range. Shock absorbers 70 with staged metering are sold by Efdyn Industrial Shock Absorbers of Tulsa, Okla. and are described in U.S. Pat. No. 4,284,177 which is incorporated by reference herein.

In fluid displacement-type shock absorbers like those sold by Efdyn, a piston responding to an impacting load moves within a cylinder, forcing hydraulic fluid therein out of one or more orifices into a reservoir. The resistive force of the piston depends upon its velocity, and the area of the orifice or orifices which control the rate at which the fluid can be displaced. The total available orifice for discharging fluid from the cylinder is progressively reduced as the piston is displaced from its initial position upon impact. The fixed orifice structure defines successive control regions, each of which is designed to provide a predetermined resistance profile and related declaration control for a respective load system or mass system. The lightest mass system, traveling at its maximum velocity within the design range, reaches its limiting declaration rate in the first control region. The heaviest mass system traveling at its lowest velocity within the design range, reaches its limiting deceleration rate in the last control region.

All loads in the design range are decelerated over the full stroke of the piston in being brought to rest.

As illustrated, trailer mounted attenuator 10 is about 7½ feet wide and 19 feet long from the outside of front vertical frame 12 to the outside of rear vertical frame 14 in expanded condition. In the trailer mounted attenuator illustrated in the drawings, a pair of shock absorbers 70 are shown, each of which is a RCOS/RCBS 3×36 shock absorber sold by Efdyn. The particular shock absorbers 70 are 57 inches long and have a 3 foot stroke. To control the collapse of scissor frame assembly 44, 25 shock absorbers 70 are pivot mounted between one of vertical uprights 54 at the ends of scissor arms 50, 52 and at an intermediate upright 72 provided between upper and lower scissor frames 46, 48.

A pair of hydraulic cylinders 74 mounted on shear pins are attached to front vertical frame 12 for extending and contracting scissor frame assembly 44. A hydraulic pump, reservoir and control panel 76 are mounted on tongue 24 for use in operating hydraulic cylinders 74. A retraction sensor switch 78 is provided to stop contraction at a desired amount. Complete contraction may not be desirable for towing trailer mounted attenuator 10 as complete contraction of scissor frame assembly 44 may render the unit so short that it is difficult for a driver to back the unit without jack knifing.

Figure 4:
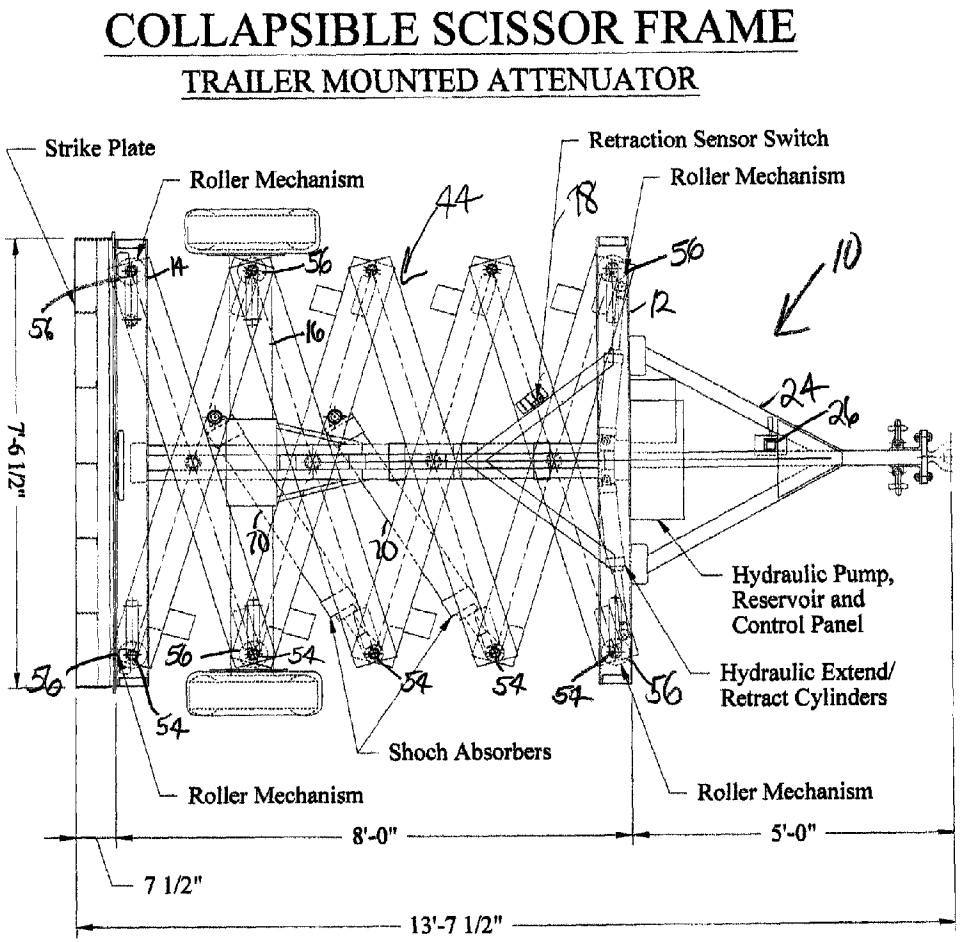
FIG. 4 is a plan view of the trailer mounted attenuator with the collapsible scissor frame contracted; and, FIG. 5 is an exploded view of a rear vertical frame, strike plate and strike plate cover.

When trailer mounted attenuator 10 is contracted as shown in FIGS. 2 and 4, it may be rested on jack 26 for storage or towed to a construction site and left attached to the towing truck. For use as a crash attenuator, cylinders 74 may be used to extend scissor frame assembly 44 into the position shown in FIGS. 1 and 3. During expansion of scissor frame assembly 44, the metering in shock absorbers 70 allows them to extend with minimal resistive force. On sudden impact such as being struck by an errant vehicle, shock absorbers 70 exert a resistive force depending on the impacting force (i.e., weight and speed of the vehicle) within the design range of the shock absorbers while cover plate 34 and vertical fins 32 tend to keep the impacting vehicle from glancing into adjacent traffic or off the road. After impact, strike plate 28 and cover plate 34 may be replaced and trailer mounted attenuator 10 thereby made ready for reuse.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A trailer mounted crash attenuator, said attenuator comprising a front vertical frame attached to a tongue, a strike plate attached to a rear vertical frame, an intermediate vertical frame mounted on an axle, said axle mounted on wheels, each of said front, intermediate and rear vertical frames having top and bottom rails with opposing tracks and a longitudinal guide, a scissor assembly having an upper and a lower horizontal scissor frame mounted on the front, intermediate and rear vertical frames, each of said scissor frames having two groups of parallel scissor arms, each scissor arm of each group with the exception of a scissor arm closest the front and rear vertical frames is pivoted to three scissor arms of the respective other group at the middle and at its two ends, said pivoted ends of the scissor arms of the upper and lower scissor frames interconnected with vertical uprights, said scissor arms of each of said frames connected at the middle to a scissor arm of the respective other group with a pin having an enlarged head, said vertical uprights at the front, rear and intermediate frames mounted on rollers which are reciprocated in the tracks on the front, intermediate and rear vertical frames to permit the upper and lower horizontal scissor frames to fold on impact each of said longitudinal guides on the front, intermediate and rear vertical frames having a longitudinal slot for receipt of one or more of the enlarged heads of the pins at the middle of the scissor arms on one of the scissor frames to keep the scissor arms from twisting as the upper and lower horizontal scissor frames fold on impact, and, at least one self-adjusting shock absorber with staged metering such that it becomes stiffer as it is compressed, said shock absorber mounted in the scissor assembly.

2. The crash attenuator of claim 1 wherein the strike plate includes a plurality of spaced apart vertical fins which are concealed by a cover plate.

3. The crash attenuator of claim 1 wherein the at least one shock absorber is custom orificed and self adjusting.

4. The crash attenuator of claim 1 wherein two shock absorbers are mounted in the scissor assembly and apply energy absorbing force on different portions of the scissor assembly.

5. The crash attenuator of claim 4 wherein each of the shock absorbers is mounted between different ones of the uprights at the ends of the scissor arms and different ones of an intermediate upright provided between the upper and lower scissor frames.

6. A trailer mounted crash attenuator, said attenuator comprising a front vertical frame attached to a tongue, a strike plate attached to a rear vertical frame, an intermediate vertical frame mounted on an axle, said axle mounted on wheels, each of said front, intermediate and rear vertical frames having top and bottom rails with opposing tracks, a scissor assembly having an upper and a lower horizontal scissor frame mounted on the front, intermediate and rear vertical frames, each of said scissor frames having two groups of parallel scissor arms, each scissor arm of each group with the exception of a scissor arm closest the front and rear vertical frames is pivoted to three scissor arms of the respective other group at the middle and at its two ends, said pivoted ends of the scissor arms of the upper and lower scissor frames interconnected with vertical uprights, said scissor arms of each of said frames connected at the middle to a scissor arm of the respective other group with a pin having an enlarged head, said vertical uprights at the front, rear and intermediate frames mounted on rollers which are reciprocated in the tracks on the front, intermediate and rear vertical frames to permit the upper and lower horizontal scissor frames to fold on impact, at least one self-adjusting shock absorber with staged metering such that it becomes stiffer as it is compressed, said shock absorber mounted in the scissor assembly, and a guide attached to the front, intermediate and rear frames, each of said guides having a longitudinal slot for receipt of one or more of the enlarged heads of the pins at the middle of the scissor arms on one of the scissor frames, said slot tapered such that the guide cams over the scissor frame on collapse of the scissor frame assembly to keep the scissor arms from twisting as the upper and lower horizontal scissor frames fold on impact.

7. The crash attenuator of claim 6 wherein the strike plate includes a plurality of spaced apart vertical fins which are concealed by a cover plate.

8. The crash attenuator of claim 6 wherein the at least one shock absorber is custom orificed and self adjusting, said crash attenuator further including a pair of hydraulic cylinders are attached to the scissor frame assembly at the front vertical frame for extending and retracting the scissor frame assembly during which movement the shock absorber is metered to provide minimal resistance.

9. The crash attenuator of claim 8 wherein two shock absorbers are mounted in the scissor assembly and apply energy absorbing force on different portions of the scissor assembly.

* * * * *